United States Patent [19]

Kerttula et al.

[11] Patent Number: 4,684,443

[45] Date of Patent: Aug. 4, 1987

[54] APPARATUS FOR GUIDING A WEB LEADER IN A PAPER MACHINE

[75] Inventors: Reima Kerttula; Olavi Viitanen, both of Jyväskylä , Finland

[73] Assignee: Valmet Oy, Finland

[21] Appl. No.: 727,444

[22] Filed: Apr. 26, 1985

[30] Foreign Application Priority Data

May 4, 1984 [FI] Finland ..... 841801

[51] Int. Cl.[4] ..... D21F 1/42; D21F 7/04

[52] U.S. Cl. ..... 162/255; 34/120; 162/193; 162/286; 226/97

[58] Field of Search ..... 162/193, 192, 255, 202, 162/286, 307, 207, 358, 359, 375, 290, 306; 34/120; 226/7, 91, 97, 92

[56] References Cited

U.S. PATENT DOCUMENTS

| | | | |
|---|---|---|---|
| 1,279,756 | 9/1918 | Pope | 162/193 |
| 1,688,267 | 10/1928 | Cram | 162/193 |
| 4,501,643 | 2/1985 | Kiuru | 162/286 |
| 4,543,160 | 9/1985 | Kertulla et al. | 162/193 |
| 4,551,203 | 11/1985 | Eskelinen | 162/202 |

*Primary Examiner*—Steve Alvo

*Attorney, Agent, or Firm*—Steinberg & Raskin

[57] ABSTRACT

An improvement in apparatus for guiding a web leader from a press section to a drying section of a paper machine, the apparatus including flexible guide ropes forming a gap into which the leader is shifted, an initial air blow device for guiding the leader towards the drying wire of the drying section, a first blow member for detaching the leader from the drying wire and a second blow member for applying transversely directed air jets onto the leader to shift it into the gap formed by the guide ropes. According to the improvement, the second air blow device includes a blow member which is mounted for pivotal movement between a non-operating lateral position outside of the edge of the drying wire and an operative position in opposed relationship thereto. One or more nozzle openings are formed in the blow member of the second air blow device for applying the transversely directed air jets onto the web leader when the blow member is in the operating position to shift the web leader into the gap formed by the guide ropes. The improvement of the invention is lightweight, requires little space and can advantageously be provided with automatic controls so that the web leader can be guided from the press section to the drying section in a completely automatic operation.

17 Claims, 4 Drawing Figures

APPARATUS FOR GUIDING A WEB LEADER IN A PAPER MACHINE

BACKGROUND OF THE INVENTION

The present invention is directed generally to paper making machines and, more particularly, to apparatus for guiding a web leader from the press section to the drying section.

Specifically, the present invention is directed to an improvement in apparatus for guiding a web leader, the apparatus being situated after the press section at the initial end of the drying section. The apparatus includes flexible guide members, such as a threading rope, band, or a group of ropes or bands, forming a gap into which the web leader is shifted in the drying section. Various air blow devices guide the web leader towards the drying wire of the drying section, detach the leader from the drying wire and laterally shift the web leader into the gap formed by the threading flexible guide members.

It is conventional in the inital start-up of a paper machine, or in the case where the paper machine is started up after the web has broken, to cut a narrow leader, e.g. having a width of about 200 mm, from the web and then to guide the web leader to threading devices. For example, the web leader can be cut from the web by means of a water jet directed against the web which is situated on a rock roll. The web leader is then usually manually guided to the threading devices by means of air jets. The threading devices in the drying section of a paper machine usually comprise pairs of ropes so that each group of drying cylinders of the drying section is provided with ropes which run over pulleys situated at the ends of the drying cylinders. The leader is usually guided between outer and inner ropes although in some arrangements three jointly operative ropes are used.

As the running speeds of paper machines have increased, an increase in difficulties in threading the end of the web have been experienced. These difficulties are most serious immediately after the press section and at the initial end of the drying section, as well as in the zones between drying cylinder groups.

Conventional threading arrangements require manual guidance of the web leader at several points in the paper machine, including at the drying section. The web leader is manually pulled in a transverse direction in the press section into the gap formed by the threading ropes and it will be understood that such operations involve safety risks due to the close proximity of rotating massive roll components. Additionally, the operator must be experienced in order to insure a reliable threading operation.

An arrangement is disclosed in application Ser. No. 653,825 filed Sept. 24, 1984, now U.S. Pat. No. 4,543,160, assigned to the assignee of the instant application, wherein a narrow leader is cut from a full-width web by means of water jets or the like preferably while the web is situated on a roll in the press section, whereupon the web leader is guided by means of air jets into the gap between the threading ropes from where it is carried between the threading ropes over the drying cylinders.

One feature of the arrangement disclosed in U.S. Pat. No. 4,543,160 is that the leader is detached from the roll in the press section by means of air jets from where the web leader is guided onwardly by means of additional air jets into connection with the drying wire of the drying section. The web leader is detached from the drying wire by means of still additional air jets directed through the drying wire, whereupon transverse air jets are directed at the leader which shift the leader into the gap between the threading ropes and between for subsequent passage through the drying section.

Another feature of the arrangement disclosed in U.S. Pat. No. 4,543,160 is that the air jets which detach the web leader from the drying wire are generated by a blow box or the like situated within the loop of the drying wire in the region of a straight run thereof and proximate to one edge thereof. The blow box is provided with nozzle openings which open toward the drying wire. The means for directing transverse air jets onto the web are situated slightly forwardly of the blow box in the direction of web run. The transverse air jets are directed substantially parallel to the plane of the drying wire at the leader detached from the drying wire by the blow box.

The arrangement disclosed in U.S. Pat. No. 4,543,610 provides a more reliable and faster web threading than was possible prior thereto. It was also possible to automate the web threading operation to avoid or at least reduce the number of risky manual steps involved in the threading of the web.

The arrangement disclosed in U.S. Pat. No. 4,543,160 is also useful in facilitating the threading of the web in the zones between the drying cylinder groups using a closed draw which in turn permits the paper machine to be run at higher speeds and enable the covering angles of the drying wires on the drying cylinders to be increased to thereby enhance the evaporating capacity of the drying section.

SUMMARY OF THE INVENTION

Accordingly, it is an object of the present invention to provide an improvement in the arrangement disclosed in U.S. Pat. No. 4,543,160 to thereby simplify the construction and improve the reliability in operation of the apparatus.

Another object of the present invention is to provide an improvement in the arrangement disclosed in U.S. Pat. No. 4,543,160 which further enhances the ability to provide an automatic control for the web threading operation.

Still another object of the present invention is to provide improved apparatus for guiding a web leader having a light-weight construction which requires little space in installation. This feature has been found to be quite important in practice since the space available for installation in a manner such that the operation of other components of the paper machine are not disturbed is very limited.

In accordance with the present invention, these and other objects are obtained by providing an improvement in the arrangement disclosed in U.S. Pat. No. 4,543,160 in which the air blow device which applies transversely directed air jets onto the leader to shift the same into the gap formed by the flexible threading members includes a blow member which is mounted for pivotal movement between a non-operating position situated outside of the edge of the drying wire and an operating position in opposed or underlying relationship to the web leader and drying wire. One or more nozzle openings and/or nozzle slots are provided in the blow member for applying the transversely directed air jets onto the web leader when the blow member is in the operating position to shift the web leader into the gap formed by the flexible threading members.

DETAILED DESCRIPTION OF THE DRAWINGS

A more complete appreciation of the present invention and many of the attendant advantages thereof will be readily understood by reference to the following detailed description when considered in connection with the accompnaying drawings in which.

DESCRIPTION OF THE PREFERRED EMBODIMENTS

Figure 1:
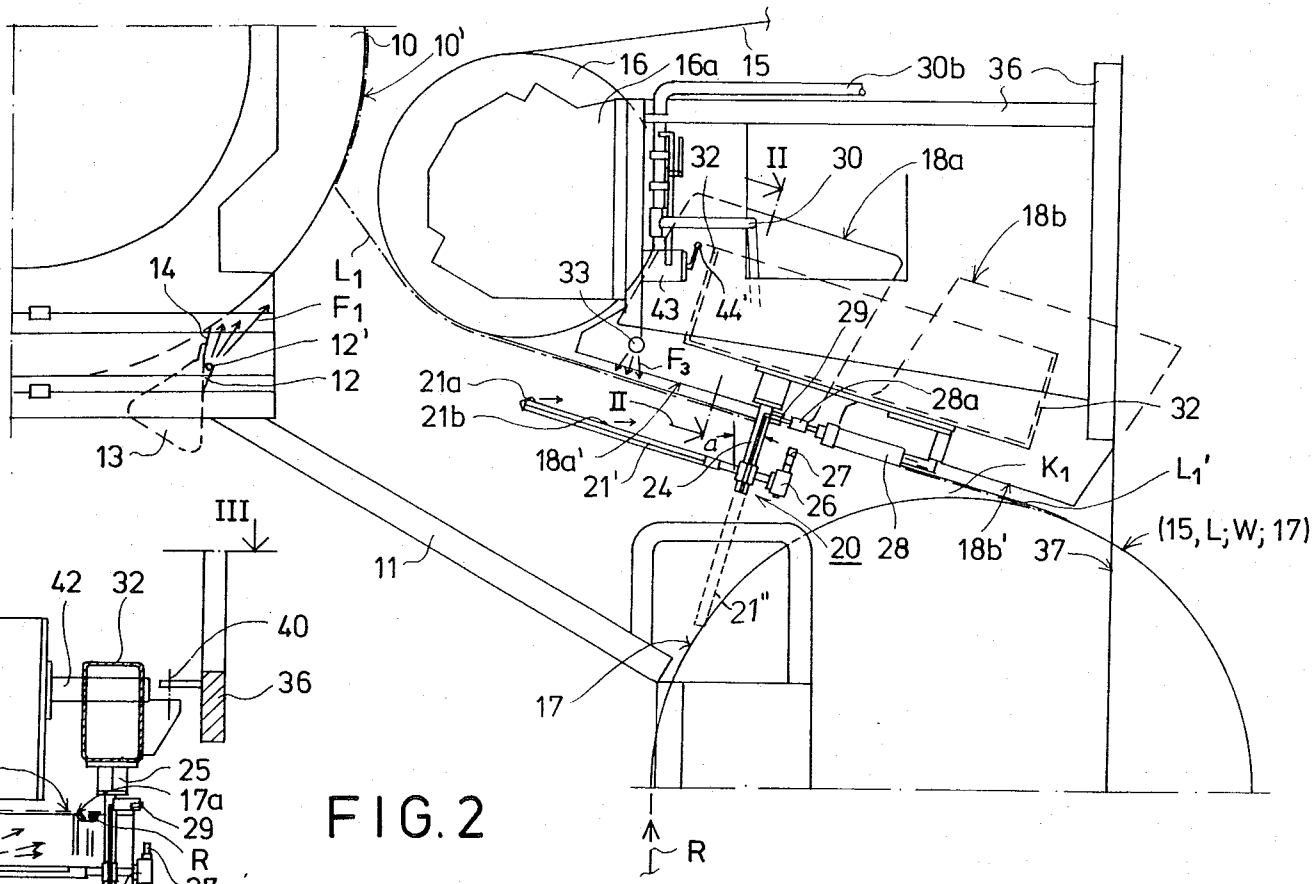
FIG. 1 is a side elevation view of the part of the paper making machine between the press section and the first drying cylinder of the drying section and within which apparatus in accordance with the invention are provided.

Referring now to the drawings wherein like reference characters designate identical or corresponding parts throughout the several views, and more particularly to FIG. 1, the paper machine press section includes a central press roll 10 such, for example, as a rock roll having a smooth-face 10'. Two press nips (not shown) are usually formed in connection with the central press roll 10. It should be understood that the invention can be used in association with other types of press sections.

A narrow web leader $L_1$, for example having a width of about 200 mm, is cut from the full-width web, such as by water jet devices. The web leader $L_1$ along with the entire web W is detached from the smooth-face 10' of press roll 10 by means of the blade 14 of a doctor 13. The web leader $L_1$ is guided forwardly by means of air jets $F_1$ issuing from the nozzles 12' of initial air blow means 12. The remainder of the web falls downwardly to broke carriage or treatment equipment (not shown) located beneath the roll 10, usually in the basement of the paper machine hall.

Figure 2:
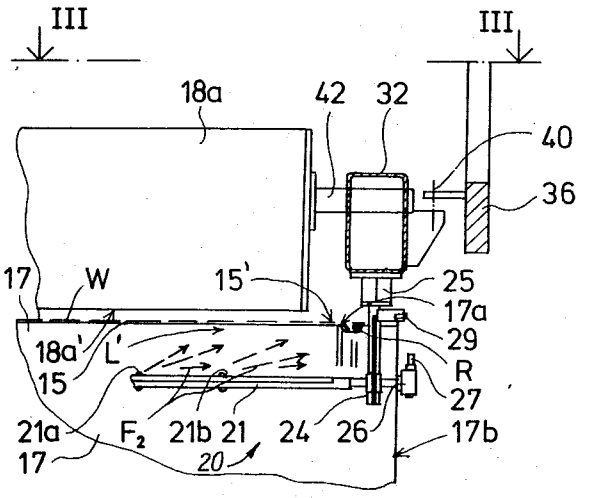
FIG. 2 is a section view taken along line II—II in FIG. 1.

Referring to FIGS. 1 and 2, the drying wire 15, preferably comprising a single-draw fabric, is guided into proximity with the central press roll 10 means of a guide roll 16 mounted on bearing supports 16*a*. The drying wire 15 has a straight run between the guide roll 16 and a baby cylinder 17 or first drying cylinder. A pair of blow boxes 18*a* and 18*b* are provided within the loop of drying wire 15. Details of the construction of blow boxes 18*a* and 18*b* are disclosed in application Ser. No. 595,969 filed Apr. 2, 1984, assigned to the same assignee as the instant application. Blow boxes 18*a* and 18*b* extend over the entire width of the web W. One or more air jets are directed onto the drying wire 15 from one or more corresponding nozzle slots (not shown) provided in the blow boxes. The air jets have a speed which is substantially higher than the speed of the drying wire 15. In this manner air is ejected from the space between the drying wire 15 and the faces 18*a'* and 18*b'* of the blow boxes. A negative pressure is thereby created in the drying wire 15 within the area of the blow box faces 18*a'* and 18*b'* which stabilizes and supports the full width web W.

As best seen in FIG. 2, a frame component 32 in the form of a box-shaped beam is attached to the side frame components 36 by means of threaded fasteners 40 passing through associated flanges. Blow boxes 18*a* and 18*b* are attached to the frame component 32 by means of connecting arms 42.

Figure 3:
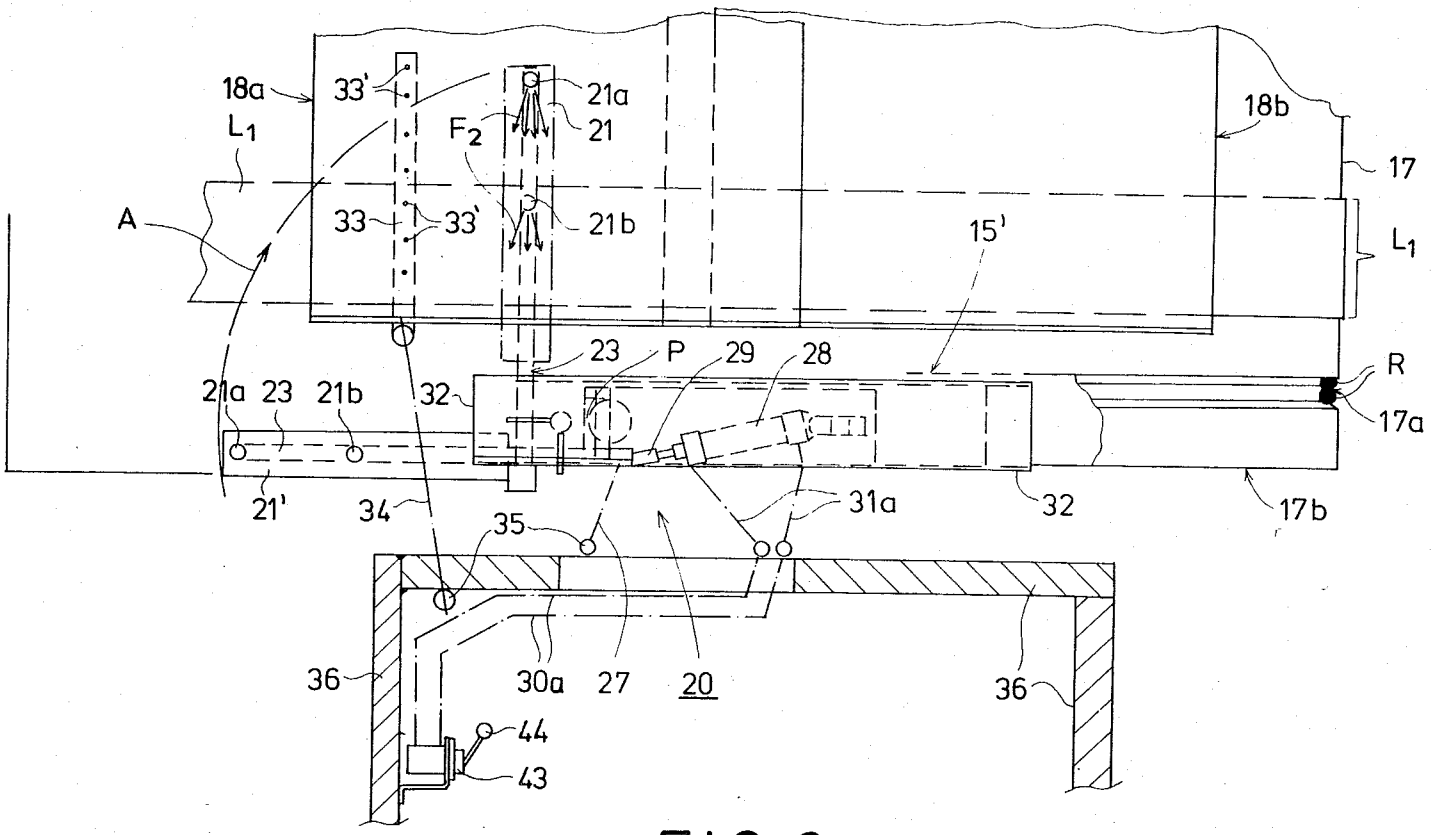
FIG. 3 is a plan view taken along the plane III—III of FIG. 2.

Referring to FIGS. 1–3, a first blow member 33 in the form of a blow pipe is situated within the loop of the drying wire 15 proximate to an edge thereof. The first blow member 33 has nozzle openings 33*a* for directing air jets $F_3$ (FIG.1) towards the inner surface of the drying wire 15 at an appropriate stage of the threading operation in order to detach the leader $L_1$ from the outer surface of the drying wire 15 in preparation for the subsequent lateral shifting of the leader described below. Thus, the first blow member 33 comprises detaching means for detaching or freeing the leader $L_1$ from the drying wire 15.

The improvement of the invention relates to second air blow means, generally designated 20, which are situated at least slightly forwardly of the first blow member 33 in the direction of web run and proximate to the edge of the drying wire for applying transversely directed air jets onto the leader $L_1$. In accordance with the improvement of the invention, the second air blow means 20 includes a second blow member 21 provided with nozzle openings 21*a* and 21*b*. Second blow member 21 comprises an elongate, substantially plate-shaped member. Second blow member 21 is pivotally mounted on a shaft 24 whose axis forms an angle a with respect to the vertical plane so that the second blow member 21 which extends perpendicularly to the shaft 24 is situated in a plane which is substantially parallel to the run of the drying wire 15 in opposed overlying relationship therewith.

The pivot shaft 24 is itself mounted on a support 25 (FIG. 2) which is connected to the frame component 32.

A tubular blow pipe 23 (FIG. 3) is situated within the second blow member 21 in which the nozzles 21*a* and 21*b* are formed. One end of the blow pipe 23 is connected by means of a mounting joint 26 (FIGS. 1 and 2) to an air hose 27 which is adapted to be connected to an air supply pipe 35 (FIG. 3).

A pneumatic piston-cylinder arrangement is provided for pivoting the second blow member 21 between non-operating and operating positions described below. The actuating cylinder 28 is attached to the frame component 32 and the piston rod 28*a* is attached to shaft 24 by means of a link pin 29.

Figure 4:
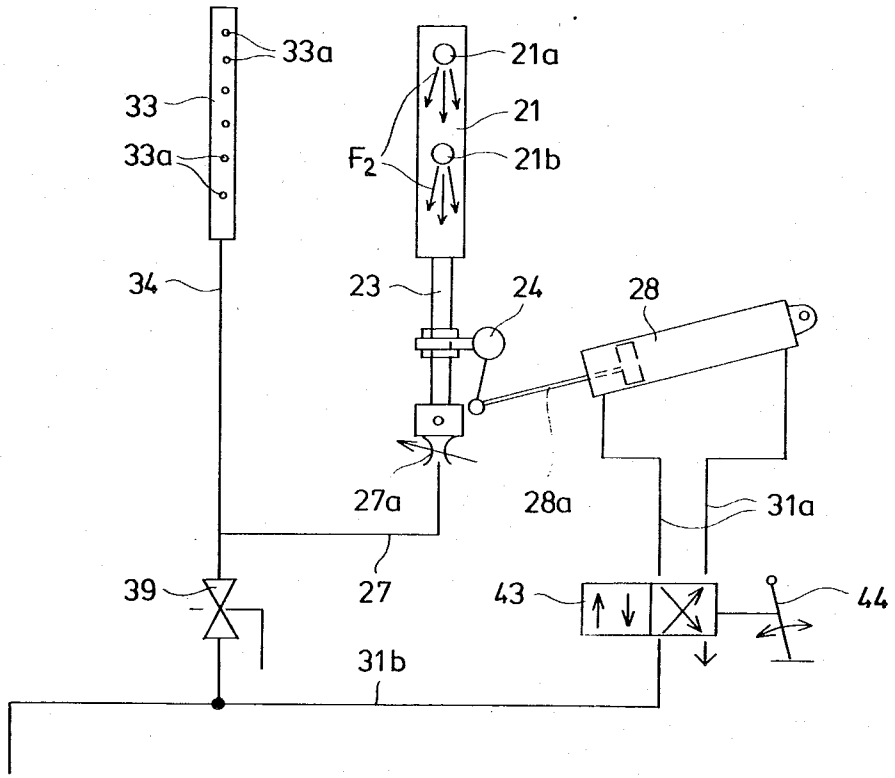
FIG. 4 is a schematic illustration of a pneumatic system for use in the apparatus of the invention.

Referring to FIGS. 3 and 4, the pneumatic cylinder 28 is connected by means of hoses 31*a* to a directional valve 43. The valve 43 is provided with a control lever 44 which can be automatically or manually controlled to actuate the cylinder 28 to pivot the second blow member 21 between its operating and non-operation positions. The directional valve 43 is connected to a source of compressed air by means of conduits 31*b*. The first blow member 33 is connected to the air system by means of a globe valve 39 and a hose 34.

When the second blow member 21 of the second air blow means 20 is in the non-operating position, the second blow member 21 is shifted to a lateral position 21' (FIGS. 1 and 3) wherein it is situated outside of the edge 15' of the drying wire 15 most advantageously to be situated substantially in the plane of the longitudinal end 17*b* of the baby cylinder or first drying cylinder 17. When the second blow means 20 is to be operated in connection with the threading of the web leader $L_1$, shaft 24 is rotated, such as by means of the piston-cylinder arrangement 28, 28*a*, to pivot the second blow member 21 to an inner position shown in FIGS. 2 and 3 in which the second blow member 21 extends substantially parallel to the axis of the drying cylinder 17 and transverse to the threading direction of the web leader $L_1$.

The operation of the apparatus will now be described.

The web leader $L_1$ is detached from the face 10' of the press roll 10 by means of the blade 14 of doctor 13, the remainder of the web being passed into the pulper or broke carriage equipment situated below the press roll. The leader $L_1$ is guided by means of the air jets $F_1$ from the initial air blow means 12, 12' to an edge region of the straight run of the drying wire 15 after the guide roll 16 in a conventional manner whereupon the leader $L_1$ adheres to the drying wire under the effect of the negative pressure produced by the blow boxes 18*a* and 18*b*.

After the run of the leader, in conjunction with the bottom surface of the edge region of the drying wire 15, has been stabilized under the negative pressure effect produced by the blow boxes 18*a* and 18*b*, operation of the first blow member 33 of the leader detaching means and of the second blow member 21 of the second air blow means 20 is initiated. Air jets $F_3$ (FIG. 1) are directed against the inner surface of the loop of drying wire 15 by means of the first blow member 33 and nozzles 33' thereof. The air jets $F_3$ provide a strong local impulse force which has the effect of detaching or freeing the leader $L_1$ locally from the outer surface of the edge region of drying wire 15 so that the leader $L_1$ can be shifted by means of the laterally directed air jets $F_2$ (FIGS. 1–4) of the second air blow means 20. The air jets $F_2$ cause the web leader $L_1$ to be shifted in the transverse direction to a location outside of a side edge 15' of the drying wire 15. The lateral air jets $F_2$ issue from the nozzles 21*a* and 21*b* provided in the second blow member 21 at least one of which directly overlies the edge region of drying wire 15 from which the web leader has been detached by first blow member 33. Under the effect of the lateral air jets $F_2$, the web leader $L_1'$ (FIGS. 1 and 2) is guided transversely and slightly diagonally to pass into the gap $K_1$ formed between the threading ropes R which run in a groove 17*a* formed in cylinder 17 so as to be guided by the ropes R into association with the cylinder 17 and onwardly therefrom.

After the web leader $L_1$ has been shifted in the manner described above under the effect of the lateral air jets $F_2$, the second air blow means 20 is pivoted until the second blow member 21 reaches its non-operating lateral position 21' shown in FIGS. 1 and 3.

The rope system for threading the web leader preferably comprises at least two ropes R which run in grooves 17*a* formed in the cylinder 17 proximate to its end 17*b*. For example, a first rope passes from below into the groove 17*a* while the second rope passes into the groove from the direction of the drying wire 15 whereby the pair of ropes form a gap K (FIG. 1) into which the leader $L_1$, is shifted.

The various operation of the apparatus in accordance with the invention may be interrelated to each other as well as to the operation of the threading rope system, such as by means of time relays and magnetic valves as will be readily understood by those skilled in the art. The devices and actuating means controlling the operation of the apparatus of the invention can advantageously be integrated with other threading systems so that the web leader can be passed from the press section through the entire dyring section from the initial start-up of the paper machine in a completely automatic manner to thereby avoid manual operations which involve safety risks as noted above.

An embodiment of the invention is described above in which the second blow member 21 is pivotted between an operating position and a non-operating position in the direction of the plane of the opposed drying fabric 15, i.e., around a shaft 24 whose axis is perpendicular to the plane of the drying wire 15. In accordance with another embodiment of the invention, the second blow member 21 can be arranged so as to be pivotal about an axis that is substantially parallel to the plane of the opposed drying wire 15 so that it will assume a non-operating position designated 21'' in FIG. 1. Indeed, the axis of the pivot shaft may assume any suitable orientation and is preferably located proximate to the edge 15' of the drying wire 15.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for guiding a leader of a web between a press section of a paper machine and an initial part of a drying section of a papaer machine, the drying section including a plurality of drying cylinders and a drying wire loop, said apparatus comprising:

at least one elongate flexible threading member forming a gap into which the leader is shifted, initial air blow means for guiding the leader toward the drying wire of the drying section so that the leader becomes attached to an edge region of said drying wire, detaching means including a first blow member situated within the loop of the drying wire proximate to an edge thereof for at least partially detaching the leader from said edge region of said drying wire, second air blow means situated at least slightly forwardly of said detaching means in the direction of web run proximate to an edge of the drying wire for applying transversely directed air jets onto the detached leader, said second air blow means including a second blow member comprising an elongate, substantially plate shaped member mounted on mounting means for movement betweeen a non-operating lateral position and an operating position extending completely across said edge region of said drying wire and said detached web leader in opposed overlying relationship to the leader and said edge region of the drying wire, said second blow member having nozzle means formed therein for applying the transversely directed air jets onto the detached leader when the second blow member is in the operating position so as to shift the detached leader into the gap formed by the at least one elongate flexible threading nember, said nozzle means including nozzle openings at least one of which is situated directly over said edge region of said drying wire and said detached web leader.

2. The combination of claim 1 wherein said mounting means include a pivot shaft whereby the movement between the non-operating positions comprises a pivotting movement with respect to the pivot shaft.

3. The combination of claim 2 wherein said pivot shaft is mounted on a frame component and further including means for moving said second blow member between said non-operating and operating positions.

4. The combination of claim 3 wherein said moving means comprises piston-cylinder apparatus.

5. The combination of claim 2 wherein the pivot shaft has an axis which is substantially perpendicular to the plane of said opposed edge region of the drying wire.

6.The combination of claim 2 wherein the pivot shaft has an axis which is substantially parallel to the plane of said opposed edge region of the drying wire.

7. The combination of claim 1 wherein said second air blow means further comprises a blow pipe situated within said second blow member.

8. The combination of claim 1 wherein said second blow member in the non-operating position is situated laterally outside of the edge of the drying wire.

9. The combination of claim 8 wherein said second blow member in the operating position is situated transversely with respect to the opposed edge region of the drying wire and substantially perpendicular to the non-operating position.

10. The combination of claim 9 further including an air hose connected to an end of said second blow member by means of a connecting member.

11. The combination of claim 1 further including means for moving said second blow member between said non-operating and operating positions, said moving means including fluid-actuated piston-cylinder means.

12. The combination of claim 11 wherein said piston-cylinder means are adapted to be connected to a source of pressurized fluid through directional valve means.

13. The combination of claim 11 further including means for automatically operating said first and second air blow means, said detaching means and said second blow member moving means.

14. The combination of claim 13 further including means for threading the web leader and wherein said automatic operating means are connected to said threading means so that the leader of the web is guided from the press section to the entire drying section in a completely automatic manner.

15. The combination of claim 1 wherein said press section includes a last press roll on which the web is carried prior to the drying section and wherein the drying wire is guided over a guide roll situated proximate to the last press roll, the drying wire having a straight run between the guide roll and an initial drying cylinder of the drying section and wherein the first blow member of the detaching means is situated within the loop of the drying wire transversely with respect to an opposed region of the drying wire, said first blow member having a plurality of nozzle openings for applying air onto an inner surface of the drying wire, said first blow member being situated slightly rearwardly of said second blow member when the latter is in the operating position.

16. The combination of claim 1 wherein the press section includes a last press roll on which the web is carried prior to the drying section and wherein the drying wire is guided over a guide roll situated proximate to the last press roll, the drying wire having a straight run between the guide roll and an initial drying cylinder of the drying section, the apparatus further including additional detaching means for detaching the web leader from the last press roll and guiding the leader onto a bottom surface of the drying wire on the straight run thereof.

17. The combination of claim 1 wherein said at least one elongate flexible threading member runs in a guide groove formed in a first one of the drying cylinders.

* * * * *